US010111478B2

(12) United States Patent
Maring

(10) Patent No.: US 10,111,478 B2
(45) Date of Patent: Oct. 30, 2018

(54) SLIP RESISTANT HEADBAND

(71) Applicant: TEAMZILA LLC, McSherrystown, PA (US)

(72) Inventor: Laura-Elliott Furbay Maring, Taneytown, MD (US)

(73) Assignee: Teamzila LLC, McSherrystown, PA (US)

( * ) Notice: Subject to any disclaimer, the term of this patent is extended or adjusted under 35 U.S.C. 154(b) by 160 days.

(21) Appl. No.: 15/176,562

(22) Filed: Jun. 8, 2016

(65) Prior Publication Data

US 2017/0354191 A1 Dec. 14, 2017

(51) Int. Cl.
*A42C 5/02* (2006.01)
*A41D 20/00* (2006.01)

(52) U.S. Cl.
CPC ..... *A41D 20/00* (2013.01); *A42C 5/02* (2013.01); *A41D 2400/82* (2013.01)

(58) Field of Classification Search
CPC ..... A42C 5/02; A42C 5/04
See application file for complete search history.

(56) References Cited

U.S. PATENT DOCUMENTS 2,320,782 A 6/1943 Larsen
2,446,705 A * 8/1948 Lampert ..... A42C 5/02 2/175.3
4,292,689 A * 10/1981 Townsend, Jr. ..... A61F 9/045 2/12
4,368,545 A 1/1983 Seidman
4,521,922 A 6/1985 Mitchell et al.
4,626,247 A 12/1986 Frankel
4,638,512 A 1/1987 Frankel
5,572,746 A 11/1996 Linico
5,640,721 A 6/1997 Jackson
5,822,798 A 10/1998 Baxley
5,826,277 A * 10/1998 McConville ..... A41D 20/00 2/171
6,567,991 B1 * 5/2003 Holslag ..... A41D 20/00 2/171
D668,843 S 10/2012 Lalonde et al.
8,613,114 B1 * 12/2013 Olivares Velasco ... A42B 3/125 2/171
9,009,869 B1 4/2015 Shapiro et al.
9,456,650 B1 * 10/2016 Boyce ..... A41D 20/00
9,763,507 B2 * 9/2017 Sze ..... A45D 8/36
2011/0191938 A1 * 8/2011 Elliott ..... A42C 5/02 2/181.2
2012/0260935 A1 10/2012 Lalonde et al.

FOREIGN PATENT DOCUMENTS

GB 2318500 A * 4/1998 ..... A41D 20/00

* cited by examiner

*Primary Examiner* — Tejash Patel
(74) *Attorney, Agent, or Firm* — Davis & Bujold PLLC; Michael J. Bujold

(57) ABSTRACT

A headband includes a length of fabric material and, attached to its inside surface, a strip of polymeric closed-cell foam material to engage the forehead or hairline of a wearer. The polymeric material has a tread pattern to resist slippage on the forehead, even under heavy perspiration.

7 Claims, 4 Drawing Sheets

SLIP RESISTANT HEADBAND

BACKGROUND OF THE INVENTION

Headbands are worn for decorative and/or functional reasons, particularly during athletic activities. One intended function of a headband is to keep perspiration out of the eyes of the wearer. Headbands are apt to slip out of place, particularly during strenuous activity, when perspiration increases the weight of the headband, and reduces the coefficient of friction between it and the forehead.

Prior inventors have developed various ways of dealing with the forehead perspiration problem. One solution is to apply an absorbent material to the inside surface of the headband.

Mitchell (U.S. Pat. No. 4,521,922) is one example.

Another group of patents intercepts perspiration before it can get in the eyes. For example, Larsen (U.S. Pat. No. 2,320,782) provided a device worn against the forehead, having an external gutter for collecting perspiration descending the forehead. Other inventors including Seidman (U.S. Pat. No. 4,368,545) and Shapiro (U.S. Pat. No. 9,009,869) provided similar solutions. It has also been proposed by Holslag (U.S. Pat. No. 6,567,991) to place a water-tight seal strip on the inside surface of a headband or cap, with the idea of diverting perspiration laterally away from the eyes.

SUMMARY OF THE INVENTION

An object of the invention is to keep a headband from slipping on the forehead, even under heavy perspiration or otherwise wet conditions.

The present invention aims not so much to redirect perspiration, as to maintain a high coefficient of friction between the headband the user's forehead, so as to keep the headband in its intended place.

This invention provides a headband with an internal anti-slip strip which is characterized by the provision of a tread pattern on the skin-facing surface of the strip. The tread prevents water or perspiration from gathering between the strip and the skin of the user, thus maintaining good adhesion.

The preferred anti-slip strip is made of a stretchable closed-cell polymeric foam which does not absorb water but has a high coefficient of friction against the skin.

BRIEF DESCRIPTION OF THE DRAWING

These and other objects of the invention are satisfied by a headband as showing in the drawing, wherein.

DETAILED DESCRIPTION OF A PREFERRED EMBODIMENT

Figure 1:
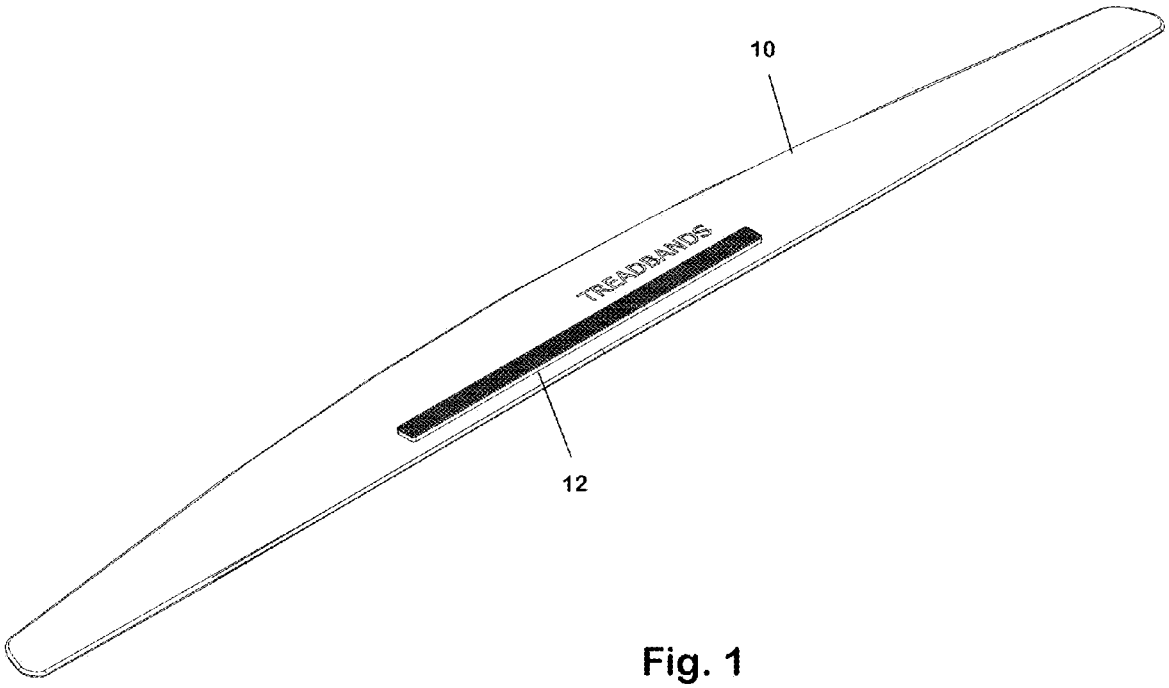
FIG. 1 is a perspective view of a headband embodying the invention.

As shown in FIGS. 1-4, a headband embodying the invention includes a piece 10 of fabric material and a strip 12 of anti-slip polymeric material attached to the fabric piece. The anti-slip material shown in the drawings is in the form of a continuous strip; however, applying the anti-slip material as a series of dots, or in another configuration is possible.

The fabric material is chosen for decorative and/or functional considerations which are well known in this field. The choice of the fabric material is not important to the present invention, other than that the anti-slip strip 12 must be connectable to it. That is, the fabric material must be compatible with a bonding agent which connects the anti-slip strip to it.

The preferred fabric material is a stretchable poly-spandex. Spandex, Lycra or elastane is a synthetic fiber known for its exceptional elasticity. Spandex is the preferred name in North America; in continental Europe it is referred to by variants of "elastane". In some countries it is sold under the trademark "Lycra".

The anti-slip material is connected to the fabric material by any suitable means, preferably an adhesive. An epoxy adhesive is suitable for the preferred fabric piece, which is made of a poly-spandex fabric, so that the anti-slip strip can stretch with the fabric. Other adhesives may be suitable. The selection of an appropriate adhesive, considering the material of the fabric 10 and the material of the strip 12, is a matter of ordinary skill.

The preferred material for the anti-slip strip is a closed-cell polymeric foam chosen to maintain flexibility over a wide temperature range. It should be substantially stretchable, if the fabric material of the headband is, so that it will not have tensile failure, or cause the adhesive to fail, when the headband itself is stretched by the use.

The presently preferred polymer is a synthetic rubber composed of styrene and butadiene, known in the trade as "SBR". An advantage of SBR is its low cost, abrasion resistance and durability. While 100% SBR is presently preferred, the SBR may be mixed with neoprene in various proportions to achieve desired characteristics, as is well known. Presently preferred dimensions of the anti-slip strip are 7 in.×0.25 in.×0.0625 in; however, the invention is not limited to a strip of any particular size.

Figure 2:
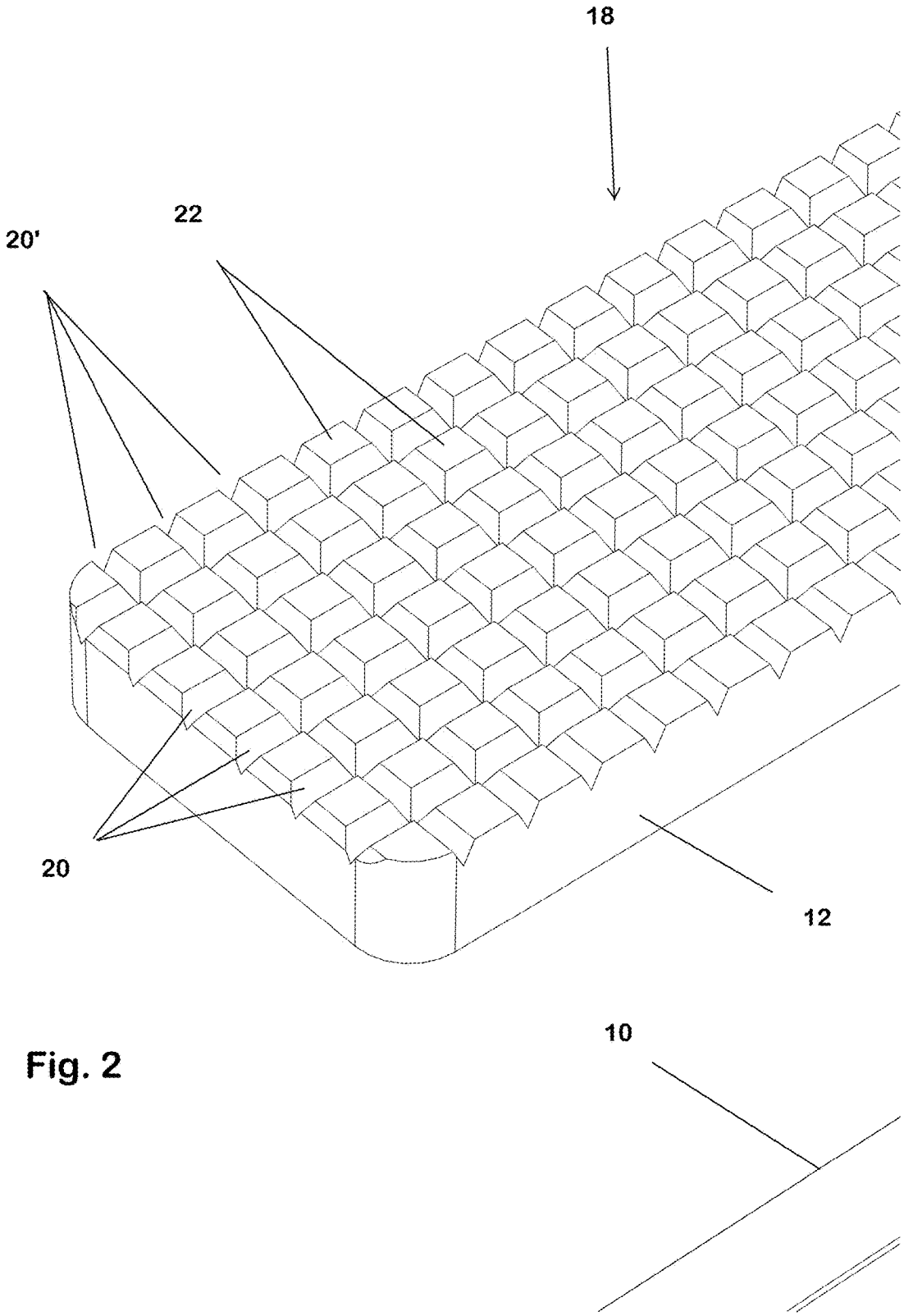
FIG. 2 is an enlarged perspective view showing an anti-slip strip portion of the headband.
Figure 3:
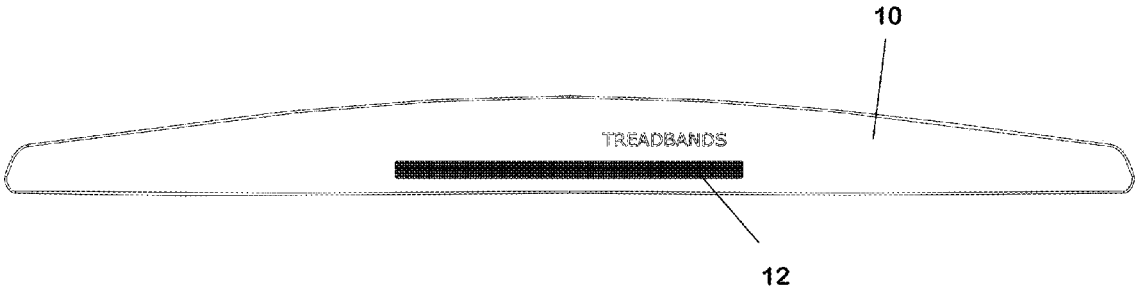
FIG. 3 is a plan view thereof.
Figure 4:
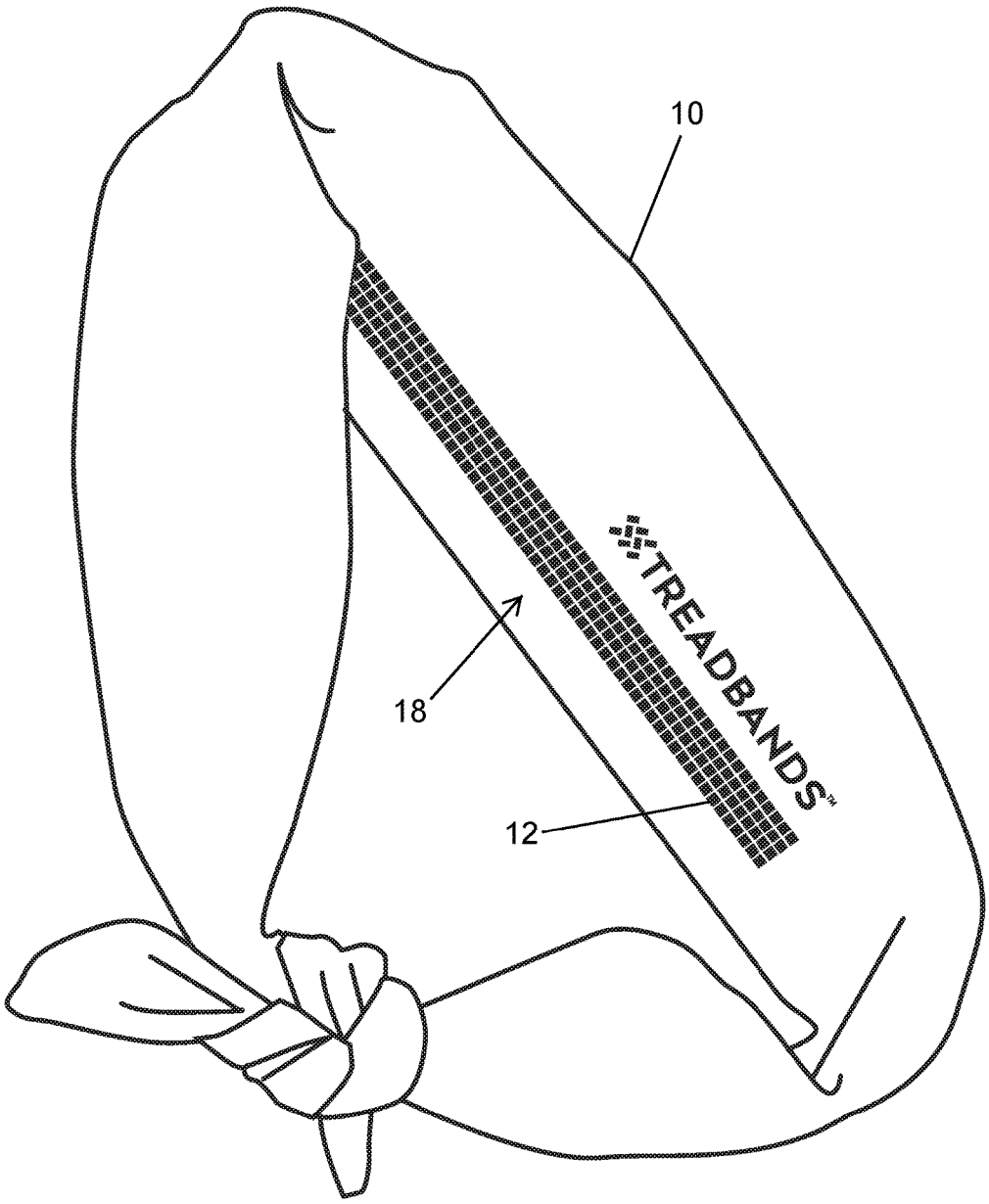
FIG. 4 is a photograph of the headband, with its ends tied to form a loop.

An important feature of this invention is that at least one surface of the anti-slip strip—the surface facing away from the fabric material—has a tread 18 intended to engage the skin. The tread preferably is formed by a number of grooves 20 in the surface of the strip. The grooves are preferably at least 0.02 in. deep, and have a spacing or "pitch" of about 0.06 in. Preferably, there are two sets 20, 20' of equally spaced straight grooves, crossing at right angles so as to form an array of peaks 22, as seen in FIG. 2. The textured tread pattern combines with the skin's natural textured pattern to create an adhesion between the two surfaces. When skin becomes moist from perspiration, the skins textured pattern softens and creates a sealed grip between the skin and anti-slip strip.

The grooves need not be straight or equally spaced. The tread might be, for example, a repeating logo, or it might spell out a trademark such as "TREADBAND" for example. The important thing is that the surface of the strip must have high points distributed on its surface with grooves or depressions therebetween to keep the strip from floating on wet skin.

When a person uses a tie back headband vs a regular headband, the applied pressure developed when tying the headband to conform exactly to a persons head provides an even greater resistance to slippage of the headband. The force combined with the coefficient of friction law provides a tight seal. The anti-slip strip grips the skin not only because of the rubber's coefficient of friction, but also because when perspiration occurs the skin softens and the texture of the skin combines with the tread grip and forms a suction-like solid connection.

The dimensions and details given above are presently preferred, but parameters outside the above ranges make prove workable, or even better in some instances.

Inasmuch as the invention is subject to variations and modification, the foregoing should be regarded as merely illustrative of the invention which is defined by the claims below.

I claim:

1. A headband comprising a piece of fabric material and at least one piece of anti-slip polymeric foam material, attached to the fabric material in a position to bear against the forehead or hairline of a user, said anti-slip polymeric foam material being selected so as to have a greater coefficient of friction against the forehead than does said fabric material, said anti-slip material having a surface facing the forehead, said forehead facing surface being provided with a tread pattern to improve headband retention when the forehead is wet, wherein the tread is formed by grooves having a depth of at least 0.02 inch and wherein the grooves are arranged in two set of grooves which cross one another so as to form an array of peaks.

2. The invention of claim 1, wherein the polymetric foam is a closed-cell foam.

3. The invention of claim 1, wherein the polymeric foam material comprises a styrene-butadiene rubber.

4. The invention of claim 3, wherein the polymeric foam material further comprises neoprene mixed with the styrene-butadiene rubber.

5. The invention of claim 1, wherein the polymeric foam material consists of a styrene-butadiene rubber.

6. The invention of claim 1, wherein the fabric material is a stretchable poly-spandex.

7. The invention of claim 1, wherein said polymeric foam is a styrene-butadiene rubber foam.

* * * * *